US006039422A

United States Patent [19]

Butters et al.

[11] Patent Number: 6,039,422

[45] Date of Patent: Mar. 21, 2000

[54] SLIDING AND TILTING SHELF DRAWER

[76] Inventors: Rex A. Butters, 1260 Cook St., Ogden, Utah 84404; Scott W. Butters, 1054 Deborah Dr., Bountiful, Utah 84010

[21] Appl. No.: 08/905,289

[22] Filed: Aug. 1, 1997

[51] Int. Cl.[7] ..... A47B 88/06

[52] U.S. Cl. ..... 312/334.1; 312/323; 312/348.3; 312/348.6; 211/181.1; 16/422; 16/445

[58] Field of Search ..... 312/323, 348.3, 312/348.6, 334.8, 334.13, 334.14, 334.1, 334.27, 334.29, 334.31, 334.32, 334.33, 334.34, 334.36, 334.39, 334.42, 334.43, 205; 16/114 R, 422, 425, 445; 220/8, 485; 211/126.15, 181.1, 94.03, 90.03

[56] References Cited

U.S. PATENT DOCUMENTS

| | | | |
|---|---|---|---|
| 321,078 | 6/1885 | Brickhead | 312/334.8 X |
| 651,739 | 6/1900 | Woodruff | 312/334.8 X |
| 721,992 | 3/1903 | Anderson | 312/323 |
| 729,180 | 5/1903 | Hunter | 312/334.8 X |
| 737,580 | 9/1903 | Carpenter | 16/114 R X |
| 876,235 | 1/1908 | Quackenboss | 220/8 |
| 1,015,722 | 1/1912 | Bezold | 312/323 |
| 2,223,074 | 11/1940 | Martin | 220/8 |
| 2,266,870 | 12/1941 | Kraeft | 312/323 |
| 2,333,967 | 11/1943 | Wells | 312/323 X |
| 2,466,033 | 4/1949 | Martin | 312/323 |
| 2,889,924 | 6/1959 | Paulucci | 312/205 X |
| 3,311,438 | 3/1967 | Barrow . | |
| 3,375,051 | 3/1968 | Anderson | 312/334.41 X |
| 3,463,343 | 8/1969 | Asenbauer | 220/8 |
| 3,586,410 | 6/1971 | Barrow . | |
| 3,803,667 | 4/1974 | Rose | 16/114 R X |
| 4,343,244 | 8/1982 | Moriarty et al. . | |
| 4,460,145 | 7/1984 | Ando . | |
| 4,466,309 | 8/1984 | Matey | 16/114 R X |
| 4,662,690 | 5/1987 | Genereaux . | |
| 4,723,680 | 2/1988 | Carroll et al. . | |
| 4,725,108 | 2/1988 | Wilson . | |
| 4,986,616 | 1/1991 | Chang et al. . | |
| 5,037,163 | 8/1991 | Hatcher . | |
| 5,209,555 | 5/1993 | Camilleri . | |
| 5,215,364 | 6/1993 | Moore . | |
| 5,226,714 | 7/1993 | Wright . | |
| 5,230,554 | 7/1993 | Camilleri | 312/334.44 X |
| 5,385,399 | 1/1995 | Weidner . | |
| 5,570,941 | 11/1996 | Rock et al. | 312/334.1 X |

FOREIGN PATENT DOCUMENTS

| | | | |
|---|---|---|---|
| 748338 | 12/1966 | Canada | 312/334.42 |
| 2155992 | 5/1973 | Germany | 312/348.3 |
| 2816547 | 10/1979 | Germany | 312/348.3 |

*Primary Examiner*—Peter M. Cuomo
*Assistant Examiner*—David E Allred
*Attorney, Agent, or Firm*—Clayton, Howarth, & Cannon, P.C.

[57] ABSTRACT

A sliding and tilting shelf drawer for storing and organizing various articles. The drawer includes a compartment that slides between a storage and an accessible position and tilts between an upright and a tilted position. The drawer also includes a base member having a pair of tracks and a pair of slide members slidingly disposed in the tracks. The compartment is pivotally attached to the slide members. The compartment has openings so that the articles may be viewed from outside the compartment and so that the drawer may be installed as a single unit. The base member has a lip for engaging a front edge of a shelf surface so that the drawer may be correctly position and easily installed. The base member may also be attached to a back wall to prevent the surface from tilting. The compartment may also be removed from the base member. The compartment may be formed of horizontal and vertical members. A handle attaches to the compartment and mates with the horizontal and vertical members. The compartment may have a first and a second portions so that the width of the compartment is adjustable to efficiently utilize the surface space.

12 Claims, 9 Drawing Sheets

SLIDING AND TILTING SHELF DRAWER

BACKGROUND

1. The Field of the Invention

This invention relates to devices used to organize and store various items within a space. More particularly, the present invention is directed to devices used to organize items which are generally stored on a shelf and to improve access to such items for a user.

2. The Background Art

Almost every home and business has cabinets, closets, shelves, or other similar types of furniture or fixtures with shelves or surfaces that can be used to hold various items. Such items may be craft supplies, articles of clothing, such as stockings, underwear, and so forth, pantry items, such as food, office supplies, and other similar items. Generally, without some type of organizer on the shelf, such items are merely thrown onto the shelf (or some other space) and the user must take the time to rummage through the various items on the shelf to find one particular item.

Thus, there is a need for a device to organize and store items on a shelf so that the different items may be more easily retrieved so that one particular item can be quickly and easily retrieved from the shelf. In order to organize and store items which are stored on shelves as well as other enclosed spaces, various structures have been proposed.

One approach is to use boxes to separate and store items. This approach provides one or more compartments on the shelf in which items can be segregated. Disadvantageously, the items cannot be seen through the box and the user is forced to itemize and list the contents of the box on the outside. Otherwise, the user is forced to look through several boxes in order to find a desired item. Merely placing boxes on the shelves is unsatisfactory since the boxes do not fit precisely on the shelf and leave unused shelf space.

In addition, many closets and cabinets have shelves that are high off the ground. A user must find a chair or stool to stand on in order to see into the shelf space. Often, the object selected to stand on is whatever is closest at hand and the user risks injury from standing on the makeshift stool. Alternatively, the user can reach beyond their sight and try to find an item by touch. This risks knocking other object off the shelf and onto the user's head.

Thus, there is a need for a device to organize and store items on a shelf so that the different items can be more easily accessible so that one particular item can be quickly and easily retrieved from the shelf.

In view of the above mentioned disadvantages, it would be an advance in the industry to provide a device for organizing and storing items on a shelf and similar enclosed spaces which overcomes these and other drawbacks.

BRIEF SUMMARY AND OBJECTS OF THE INVENTION

In view of the above described state of the art, the present invention seeks to realize the following objects and advantages.

It is a primary object of the present invention to provide an organizing and storing device for shelves and other spaces which is efficient and easy to use.

It is also an object of the present invention to provide an organizing and storing device for shelves and other spaces which can be adjustably sized to precisely fit at least one dimension of the shelf so that space on the shelf is efficiently used but does so without requiring any cutting or permanent alterations of the device.

It is a further object of the present invention to provide an organizing and storing device for shelves and other spaces which can be tilted so that the stored items are more easily accessible and visible.

It is a further object of the present invention to provide an organizing and storing device for shelves and other spaces such that the items stored in the device can be seen.

It is a further object of the present invention to provide an organizing and storing device for shelves and other spaces which can be easily positioned and installed on the shelves.

It is a further object of the present invention to provide an organizing and storing device for shelves and other spaces which can be removed from the shelf as needed.

These and other objects and advantages of the invention will become more fully apparent from the description and claims which follow, or may be learned by the practice of the invention.

The present invention provides a sliding and tilting shelf drawer that slides between a storage position and an accessible position and tilts between an upright position and a tilted position for organizing and storing various articles in a space.

The space may have a first horizontal surface, such as a shelf, and a second horizontal surface disposed above and parallel with the first surface, such as another shelf or cabinet top. The space may also have a back wall perpendicular to the first horizontal surface. The first horizontal surface also has a front edge. The space may have a width defined by side walls; a depth defined by the front edge and the back wall, or a back of the surface, and a height defined by the first and second horizontal surfaces.

The drawer of the present invention is disposed on the first surface. The drawer has a compartment that slides and tilts and is operatively coupled to a base member disposed on the horizontal surface.

The compartment is configured to include a bottom, front, back, and left and right sides. A ridge is formed around at least a portion of an upper rim of the compartment. The compartment is preferably formed with openings so that the various articles held in the compartment may be viewed from outside the compartment. In addition, the openings facilitate installation of the drawer. The compartment is preferably formed of U-shaped traverse and longitudinal wires welded together at spaced intervals and coated with plastic. The upturned portions of the U-shaped wires form vertical portions of the compartment. Horizontal members, most preferably wires, are welded to the vertical members complete the front, back, and left and right sides of the compartment and the members are attached together at their points of intersections.

In accordance with one aspect of the present invention, a handle is preferably attached to the front of the compartment for a user to grasp and slid the compartment. The handle includes a bolt and nut. The bolt mates with the horizontal and vertical members at an intersection. The bolt has a horizontal and a vertical slots formed for receiving the horizontal and vertical members at an intersection. The nut secures the members between the bolt and nut within the slots.

In accordance with another aspect of the present invention, an elongated divider extends between the left and right sides for dividing the compartment and maintaining the various articles within the compartment when tilted. A vertical slot is formed in either end of the divider for receiving a vertical member from the left side and the right side. The divider may extend between horizontal members as well as between the front and back of the compartment.

The base member preferably has a pair of tracks formed as a C-shaped channel. Rollers are attached at the front of the track. A forward member and a back member extend between the pair of tracks and attach to the pair of tracks to maintain a parallel configuration. The back member may be attached to the underlying horizontal surface, or to a back wall which is part of the enclosed space, to prevent the base member or the horizontal surface from being displaced when the compartment is slid into the accessible position.

A lip is preferably formed integrally with the forward member (attached to the pair of tracks) so that the best position of the pair of tracks on the horizontal surface can be accurately and easily located during installation of the device. The lip engages the front edge of the horizontal surface to position the base member such that the tracks are maintained in a perpendicular orientation with respect to the front edge.

Slide members are slidingly disposed in the tracks and slide between the storage position and the accessible position. The slide members are preferably formed as elongated, L-shaped members. Rollers are preferably attached to the back end of the slide members and are disposed in the tracks. Thus, the slide members ride on the rollers in the track while the rollers on the slide members ride in the tracks. A first and a second member extend between and attach the slide members to maintain a parallel configuration.

The compartment is pivotally attached to the slide members. The second member acts as an axle or pivot. A pair of sleeves is disposed on the member and are free to rotate. A pair of skids are preferably attached to the sleeves and the compartment is attached to the skids. As the compartment slides, the skids slide on a low-friction pad disposed on the forward member of the base member.

The slide members extend straight out as the compartment is slid from the storage position to the accessible position. As the compartment tilts between the upright position and the tilted position, a forward end of the slide members abuts the ridge of the compartment, thus limiting the amount of tilt.

The drawer may span the vertical distance between the first horizontal surface and the second horizontal surface to efficiently maximize the usage of the space. With such a limited clearance, the compartment may still slide out from the storage position to the accessible position and tilt from the upright position to the tilted position without interfering with the second horizontal surface. In addition, when in the accessible and tilted position, the compartment may be removed from the base member without interference from the second horizontal surface.

In accordance with another aspect of the present invention, the compartment preferably includes a first and a second portion slidingly attached to one another such that the width of the compartment may be adjusted to efficiently fit in the desired space. When the compartment has an adjustable width, the base member may not have a forward and back member connecting them together. In such a case, a lip and mounting holes may be formed on the tracks themselves for positioning the tracks and attaching them to the underlying horizontal surface or to the back wall. In addition, mounting brackets may be attached to the tracks. The tracks preferably have feet that protrude underneath the compartment. Mounting holes are formed in the feet and are accessible through the openings in the compartment. Thus, the compartment and tracks may be positioned on the surface as desired and attached to the underlying horizontal surface, preferably by inserting a screw through the mounting hole and driving it with a screwdriver extending through the opening in the compartment. In this way, the compartment does not have to be removed from the tracks and it is unnecessary to measure and mark the position of the track in order to install the drawer.

BRIEF DESCRIPTION OF THE DRAWINGS

In order to better appreciate how the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

Figure 1:
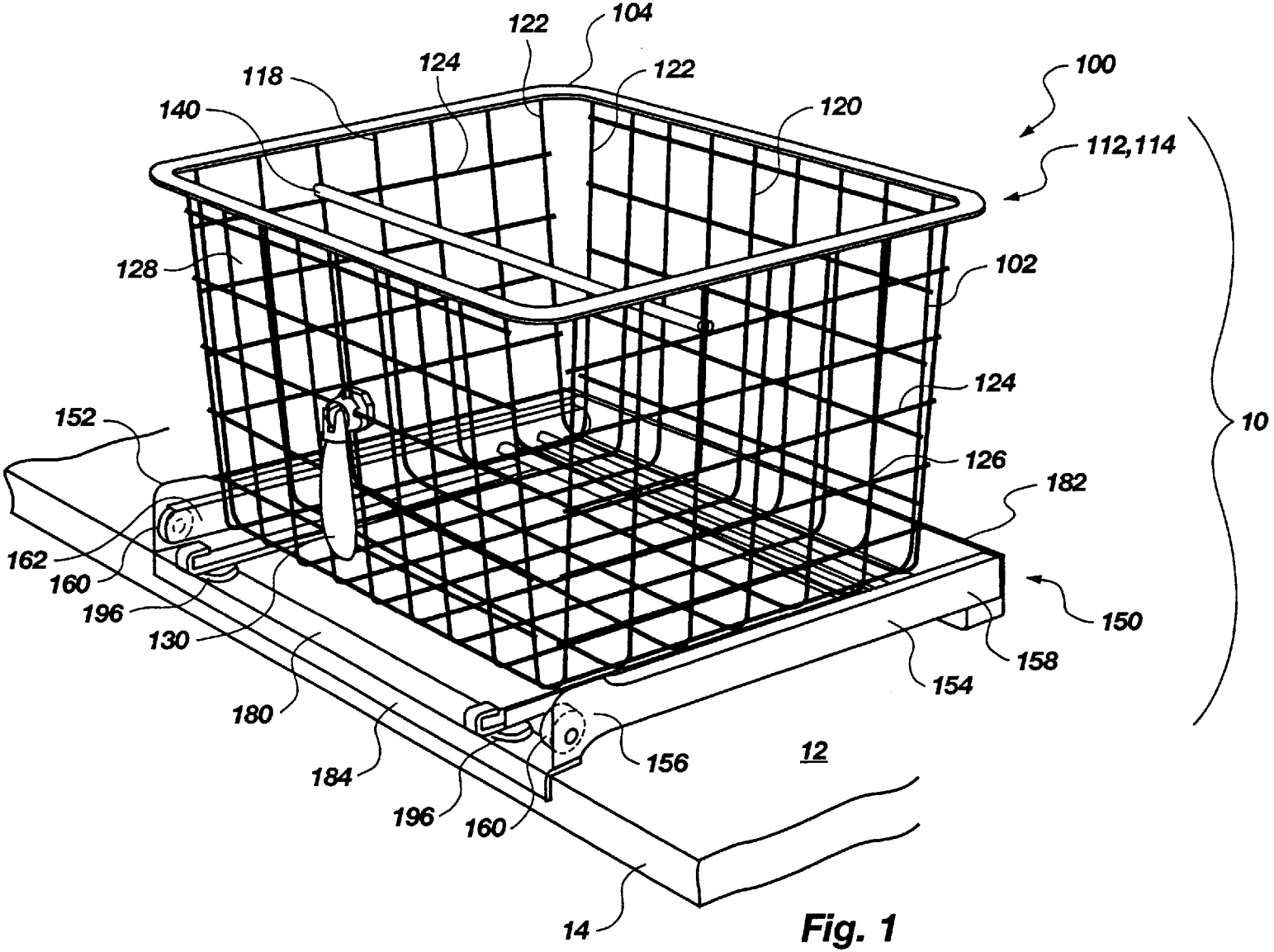
FIG. 1 is a perspective view of the first presently preferred embodiment of the present invention disposed on a horizontal surface.

Reference will first be made to FIG. 1 which is a perspective view of a sliding and tilting shelf drawer in accordance with the present invention, generally designated at 100, disposed in a space, designated by bracket 10. The space 10 may be a closet, shelf, cabinet, or other enclosed or open space used to store various items.

Figure 4:
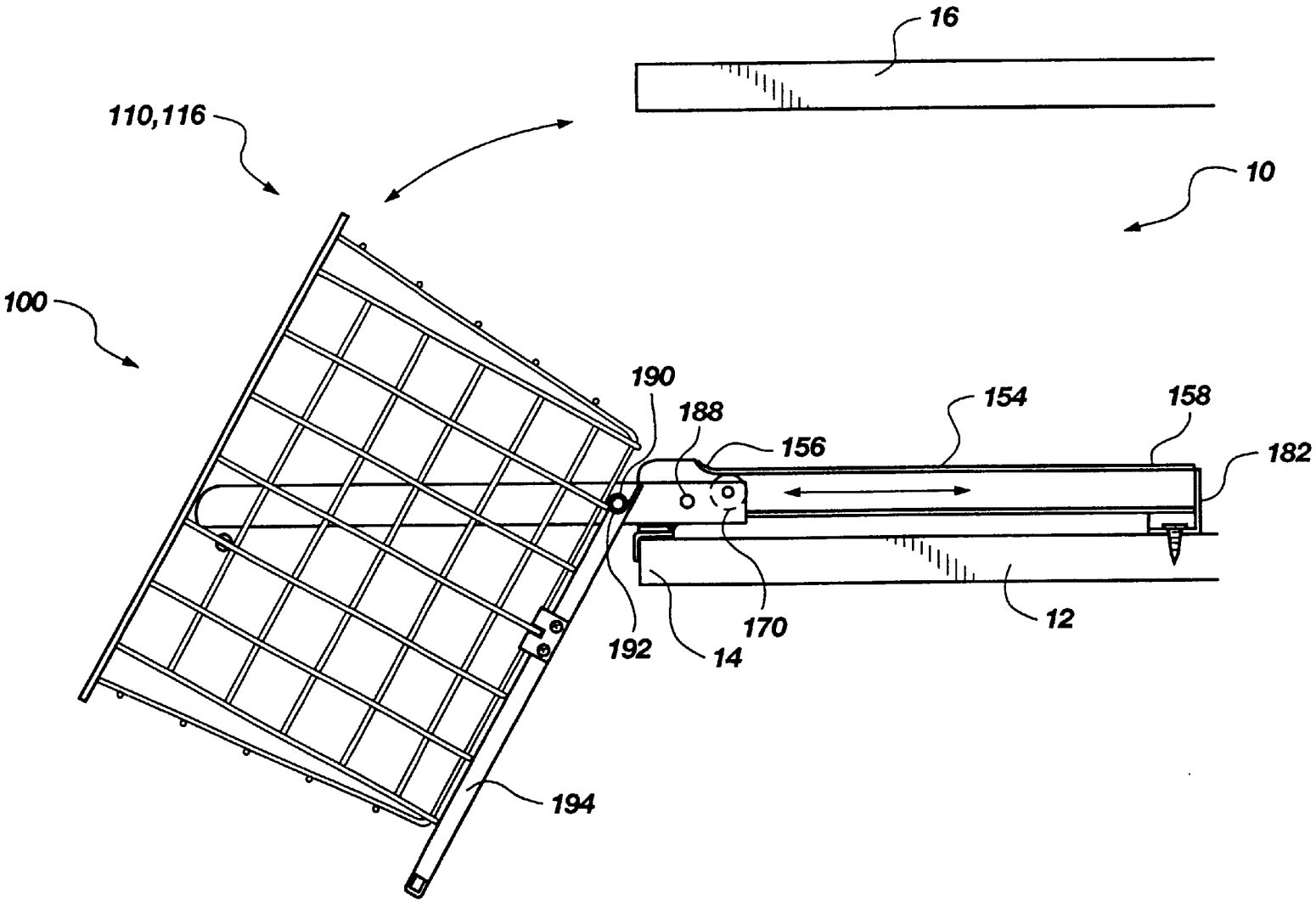
FIG. 4 is a side view of the first presently preferred embodiment of the present invention represented in FIG. 3 in an accessible and tilted position.
Figure 5:
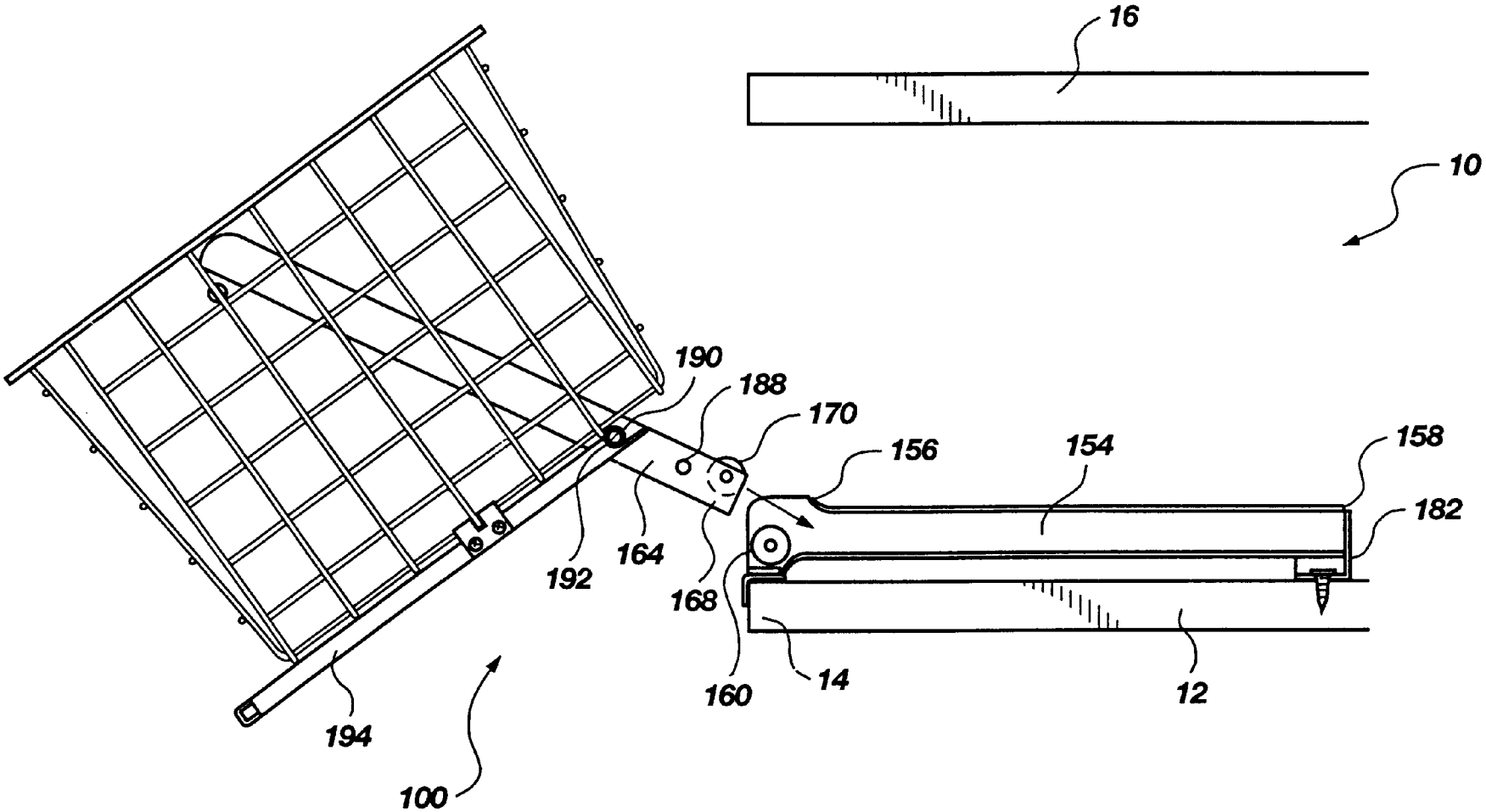
FIG. 5 is a side view of the first presently preferred embodiment of the present invention represented in FIG. 3 wherein the compartment has been removed from the base member.

As can be seen in FIG. 1, the space 10 has a horizontal surface 12, such as a shelf. The surface 12 has a front edge 14. The space 10 may also have a back wall (not shown in FIG. 1) as is typical with cabinets or closets. The back wall is generally perpendicular to the horizontal surface 12. It is to be understood that while the surface to which the sliding and tilting shelf drawer 100 is attached is preferably horizontal, the present invention also has applications with non-horizontal surfaces and the description of a shelf or other structure as a horizontal surface is intended as merely exemplary and not limiting. The space may not have a back wall as with open shelves that are accessible from either side. In addition to the horizontal surface 12, which may be designated herein as a first surface, the space may have a second horizontal surface 16, such as another shelf or cabinet roof, disposed above and parallel with the first horizontal surface 12, as shown in FIGS. 3–5.

Figure 2:
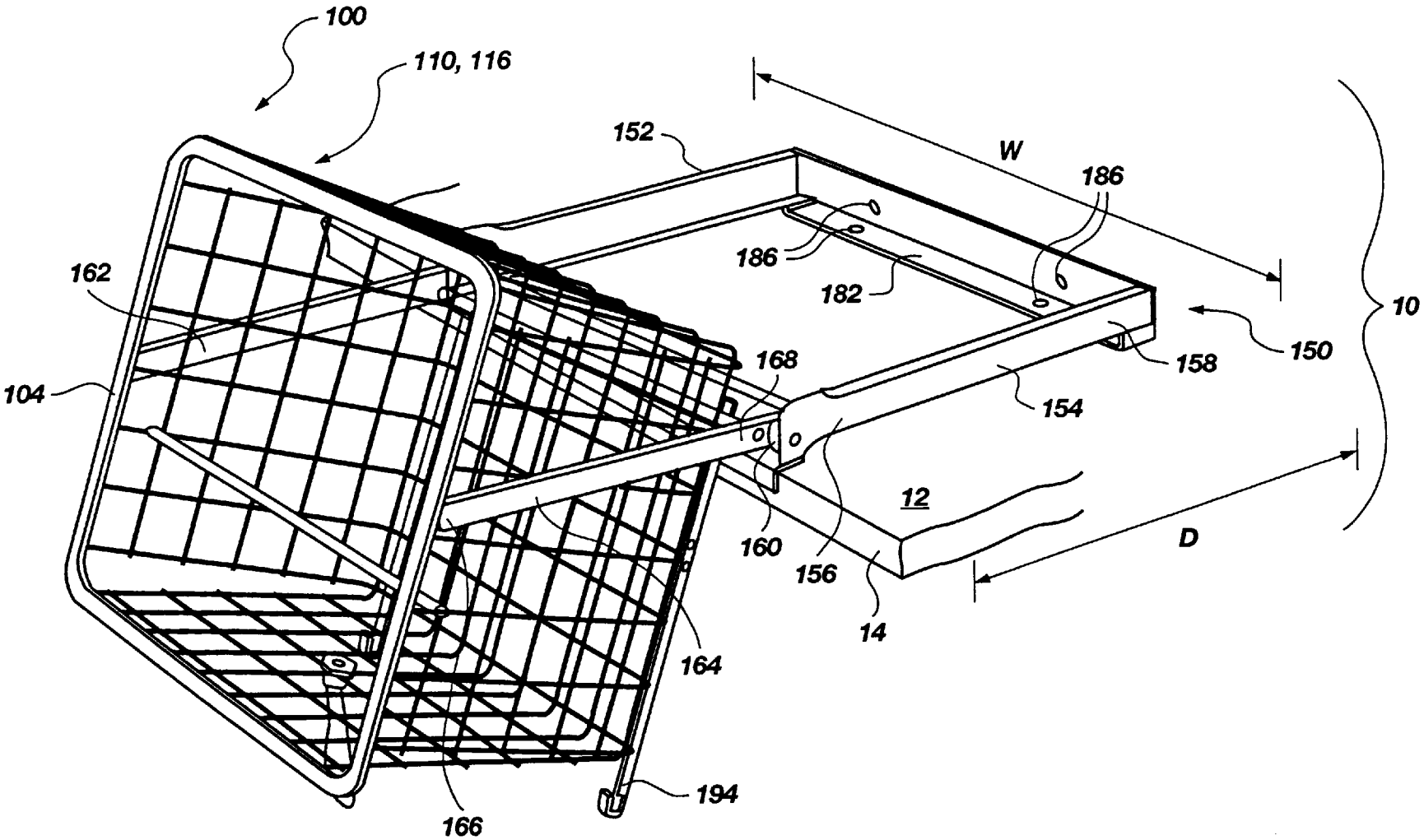
FIG. 2 is a perspective view of the first presently preferred embodiment of the present invention in an accessible and tilted position.
Figure 3:
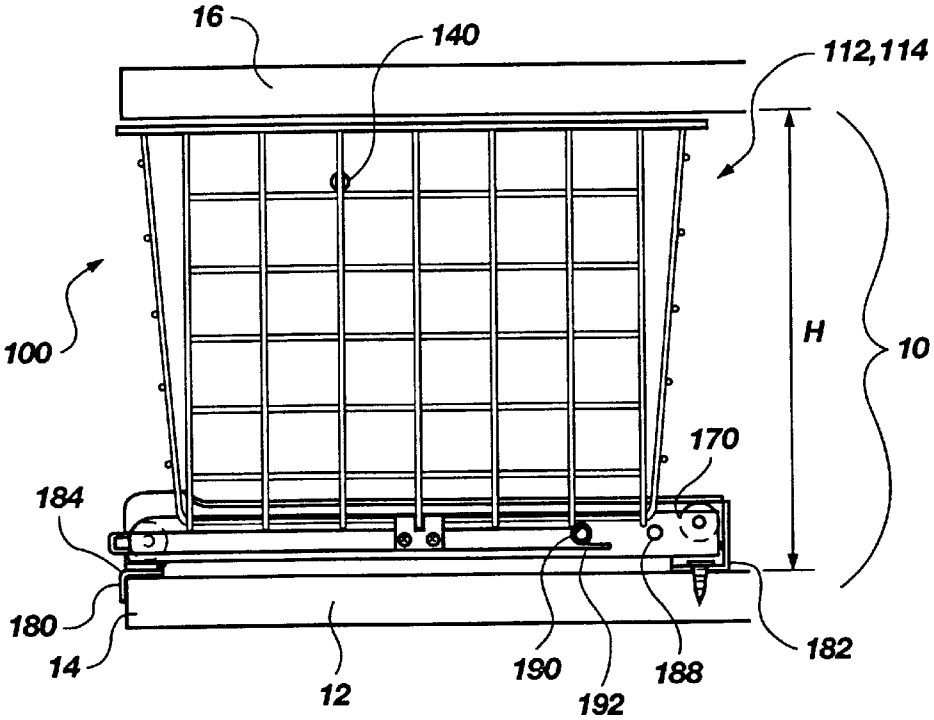
FIG. 3 is a side view of the first presently preferred embodiment of the present invention disposed in a space having very limited vertical clearance.

The space 10 preferably includes a width W, a depth D, and/or a height H, as shown in FIGS. 2 and 3. The width may vary significantly depending the environment in which the sliding and tilting shelf drawer 100 is installed, such as with a narrow closet or a broad shelf. The width may be limited by the sides of the closet or cabinet. The depth may be limited by the front edge 12 and any back wall or by the front edge 14 a back edge of the horizontal surface 12. As known in the industry, the depth may also vary but usually has a standard dimension such as is found in cabinets and closets. The height may also vary as is the case with adjustable shelves or the height can be set to one or more standards, as is common with cabinets. The height in many case is limited by the distance between the first and second surfaces, best shown at 12 and 16 in FIG. 3.

While the space 10, such as a shelf, is an example of the type of space which can best benefit from the present invention, it will be appreciated, however, that other types of spaces, for example open shelves, enclosed shelves, storage room shelves, closet shelves, pantry shelves, kitchen cabinets, storage cabinets, and other structures, can benefit from embodiments of the present invention.

Referring again to FIG. 1, the sliding and tilting shelf drawer 100 includes a compartment 102. The compartment 102 is preferably configured like a typical drawer, having a box-like structure including a bottom, front, back, and left and right sides. In addition, the compartment preferably has a ridge 104 formed on all, or a portion, of the upper rim of the back, front, and left and right sides.

The compartment 102 slides between an accessible position 110, as shown in FIGS. 2 and 4, and a storage position 112, as shown in FIGS. 1 and 3. The compartment 102 also tilts between an upright position 114, as shown in FIGS. 1 and 3, and a tilted position 116, as shown in FIGS. 2 and 4.

Referring again to FIG. 1, the compartment 102 preferably has openings formed therein so that the various articles within the compartment can be seen from outside the compartment. The compartment 102 is preferably formed of ventilated wire. The ventilated wire is a wire frame material having cris-crossed wires attached together and coated in plastic. A traverse set of spaced apart U-shaped wires (one of which is indicated at 118) is attached to a longitudinal set of spaced apart U-shaped wires (one of which is indicated at 120) to form the bottom of the compartment 102. The upturned portions of the U-shaped wires 118 and 120, forming a plurality of vertical members (one of which is indicated at 122), together with a plurality of horizontal members (one of which is indicated at 124), such as wire segments, are orthogonally arranged and complete the front, back, and left and right sides of the compartment 102. The horizontal members 124 are attached, for example by welding, to the vertical members 122 of the U-shaped wires 118 and 120 at their intersections (on of which is indicated at 126). The wire frame configuration of the compartment 102 provides openings 128 through which the various articles can be seen from outside the compartment 102 and allows air circulation through the compartment 102.

Figure 6B:
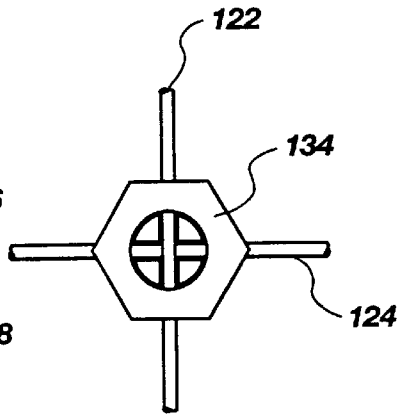
FIG. 6*b* is a detailed back view of the handle represented in FIGS. 1–2.
Figure 6A:
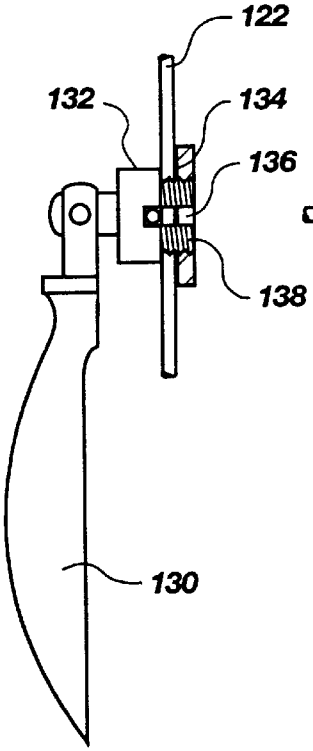
FIG. 6*a* is a detailed side view of the handle represented in FIGS. 1–2.

Referring now to FIGS. 6*a* and 6*b*, a handle 130 is disposed on the front of the compartment 102. The handle 130 allows a user to slid the compartment 102 between the accessible position (110 in FIG. 4) and the storage position (112 in FIG. 3). The handle 130 may be a pull tab, as shown, or may be any suitable handle, such as a ring, chain, knob, hook, or tab.

The handle 130 is preferably attached to the compartment 102 by a bolt 132 and a nut 134. The handle 130 is attached to the bolt 132, preferably via a tilting mechanism represented in FIG. 6*a*. The bolt 132 has a horizontal slot 136 configured for receiving one of the plurality of horizontal members 124 and a vertical slot 138 configured for receiving one of the plurality of vertical members 122. The slots 136 and 138 in the bolt 132 are formed perpendicular to the longitudinal axis of the bolt 132. Thus, the bolt 132 mates with a horizontal and vertical members 122 and 124 at an intersection 126. The nut 134 screws onto the threads of the bolt 132, securing the members 122 and 124 between the nut 134 and bolt 132 and thus attaching the handle 130 to the compartment 102 which greatly assists a user when pulling the compartment 102 to an accessible position.

Referring to FIGS. 1 and 3, the compartment 102 has an elongated divider 140 extending between the left and right sides of the compartment 102. The divider 140 segregates the compartment 102 and helps prevent the various articles from exiting, or falling out of, the compartment 102 when the compartment 102 is tipped into the tilted position (116 in FIG. 4). The divider 140 has a first end and a second end. Vertical slots are formed in each of the first and second ends (as can be seen in FIGS. 1–4) and the vertical slots are configured for receiving the vertical members 122 on the right and left sides of the compartment 102. The compartment 102 has a width defined by the distance between the members of the left and right sides. The divider 140 has a length greater than the width of the compartment 102 but the distance between the bottom of the slots is less than or the same as the width of the compartment 102 at the location where the divider 140 is to be installed. Therefore, the divider 140 is held between opposing vertical members 122 of the left and right sides. The divider 140 may be placed between any of the vertical members 122 at a desired location. The divider 140 is preferable held between vertical members 122 because it will be easier to remove and relocate but may also be held between the horizontal members 124.

It is of course understood that the divider 140 may also extend between the front and back of the compartment 102 and that any number of dividers may be used.

Referring to FIGS. 1–5, the sliding and tilting shelf drawer 100 has a base member, generally designated at 150, disposed on the horizontal surface 12. Preferably, the base member 150 has a left track 152 and a right track 154. The tracks 152 and 154 are formed as C-shaped channels. The tracks 152 and 154 have a forward end 156 and a back end 158. Track rollers 160 are attached to the forward end 156 of the tracks 152 and 154 inside the channels. A left slide member 162 and a right slide member (164 in FIG. 2) are slidingly disposed in the tracks 152 and 154. The slide members 162 and 164 are configured as elongated, inverted L-shaped members. The slide members 162 and 164 have a forward end 166 and a back end 168. Slide rollers (one of which is indicated at 170 in FIGS. 3–5) are attached to the back ends 168 of the slide members 162 and 164. The slide rollers 170 are disposed inside the tracks 152 and 154. The slide members 162 and 164 are disposed such that they ride on the track rollers 160 while the slide rollers 170 ride inside the tracks 152 and 154. In this manner, the compartment 102 may be slid between the storage position 112 and the accessible position 110.

Although the present embodiment has been described with reference to tracks, slide members, and rollers, it is of course understood that there are any number of ways to effect the sliding motion of the compartment, such as with roller bearings, low friction pads, nested tracks, and tongue-and-groove structures, and that the presently described tracks may be positioned in various locations, such as beneath, on the lower sides, or on the upper sides of the compartment.

Referring to FIGS. 1 and 2, in the preferred embodiment, the base member 150 has a forward member 180 and a back member 182. The forward and back members 180 and 182 extend between the tracks 152 and 154 and hold the tracks together while maintaining the tracks in a parallel configuration.

A lip 184 is formed on the base member 150. In the preferred embodiment, the lip 184 is formed integrally with the forward member 180 as an elongated, L-shaped member. Alternatively, the lip 184 may be formed on the forward ends 166 of the tracks 152 and 154. The lip 184 engages the front edge 14 of the horizontal surface 12. The lip 184 enables the drawer 100, or specifically the base member 150, to be easily and correctly positioned on the horizontal surface 12 for installation. The lip 184 insures that the tracks 152 and 154 will be positioned perpendicular with the front edge 14 such that the compartment 102 will correctly slide perpendicularly to the front edge 14.

The back member 182 is preferably an elongated, L-shaped member. Mounting holes 186 are formed in the back member 182 for securing the base member 150 to the horizontal surface 12 or to a back wall. Securing the base member 150 to the horizontal surface 12 insures that the weight of the compartment 102 and various articles will not cause the displacement of the base member 150 with respect to the horizontal surface 12 when the compartment 102 is slid to the accessible position 110. Furthermore, securing the base member 150 to the back wall insures that the weight of the compartment 102 and the various articles will not cause the displacement of the horizontal surface 12 when the compartment 102 is slid to the accessible position 110. To keep the horizontal surface 12, such as a shelf, from tipping when the compartment 102 is withdrawn to the accessible position 110, it is preferred that the base member 150 be secured to the back wall.

Alternatively, the tracks may not be connected by a forward and back members but may be separate. The tracks may then have a lip formed on the forward end and holes formed in the back end.

Referring to FIGS. 2, 4 and 5, the left and right slides 162 and 164 are preferably connected. A first member 188 extends between the back end 168 of the slide members 162 and 164 connecting them together. A second member 190 also extends between the slide members 162 and 164. The first and second members 188 and 190 keep the left and right slide members 162 and 164 connected and parallel. Alternatively, the slide member 162 and 164 may be connected by the compartment 102.

The compartment 102 is attached to the slide members 162 and 164 and slides between the accessible position 110 and the storage position 112 on the slide members. In addition, the compartment 102 is pivotally attached to the slide members 162 and 164. Preferably, the second member 190, extending between the slide members, forms a pivot or axle about which the compartment 102 pivots. Two sleeves 192 are disposed near the ends on the second member 190 and are free to rotate about the member 190. The sleeves 192 are also coupled to the compartment 102 so that the compartment may pivot with respect to the second member 190. In addition, two skids 194 are attached to the sleeves 192 and the bottom of the compartment 102. As the compartment 102 slides between the storage position 112 and the accessible position 110, the compartment 102 rides on the skids 194. The skids 194 preferably ride on low-friction pads 196 (as seen best in FIG. 1) attached to the forward member 180, as shown in FIG. 1. Alternatively, the low-friction pads 196 may be attached to the horizontal surface 12, or the skids 194 may ride on the horizontal surface 12 itself.

Preferably, the tilt of the drawer 100 may be limited so that the orientation of the drawer 100 does not exceed a desired angle of orientation. Referring to FIG. 2, as the compartment 102 slides out to the accessible position 110, the slide members 162 and 164 slide straight out from the tracks 152 and 154. As the compartment 102 tilts into the tilted position 116, the ridge 104 on the rim of the compartment 102 abuts the forward end 166 of the slide members 162 and 166, limiting the tilt of the drawer 100 in the tilted position 116.

Referring to FIGS. 3 and 4, the drawer 100 may span the vertical distance, or height H, between the first and second surfaces 12 and 16. In many applications, the space 10 is limited. Thus, the drawer 100 advantageously slides out from the space 10 or surfaces 12 and 16, between the storage position 112 and the accessible position 110, and tilts between the upright position 114 and the tilted position 116, without contacting the second surface 16.

In addition, referring to FIG. 5, the drawer 100 is preferably removable. In many applications, it will be desirable to remove the compartment 102 itself so that all of the various articles may be moved at once. Thus, when the drawer 100 is slid to the accessible position 110 and tilted to the tilted position 116, the compartment 102 may be removed from the base member 150 without interfering with the second surface 16. In doing so, the slide members 162 and 164 lift out of the tracks 152 and 154.

Figure 7:
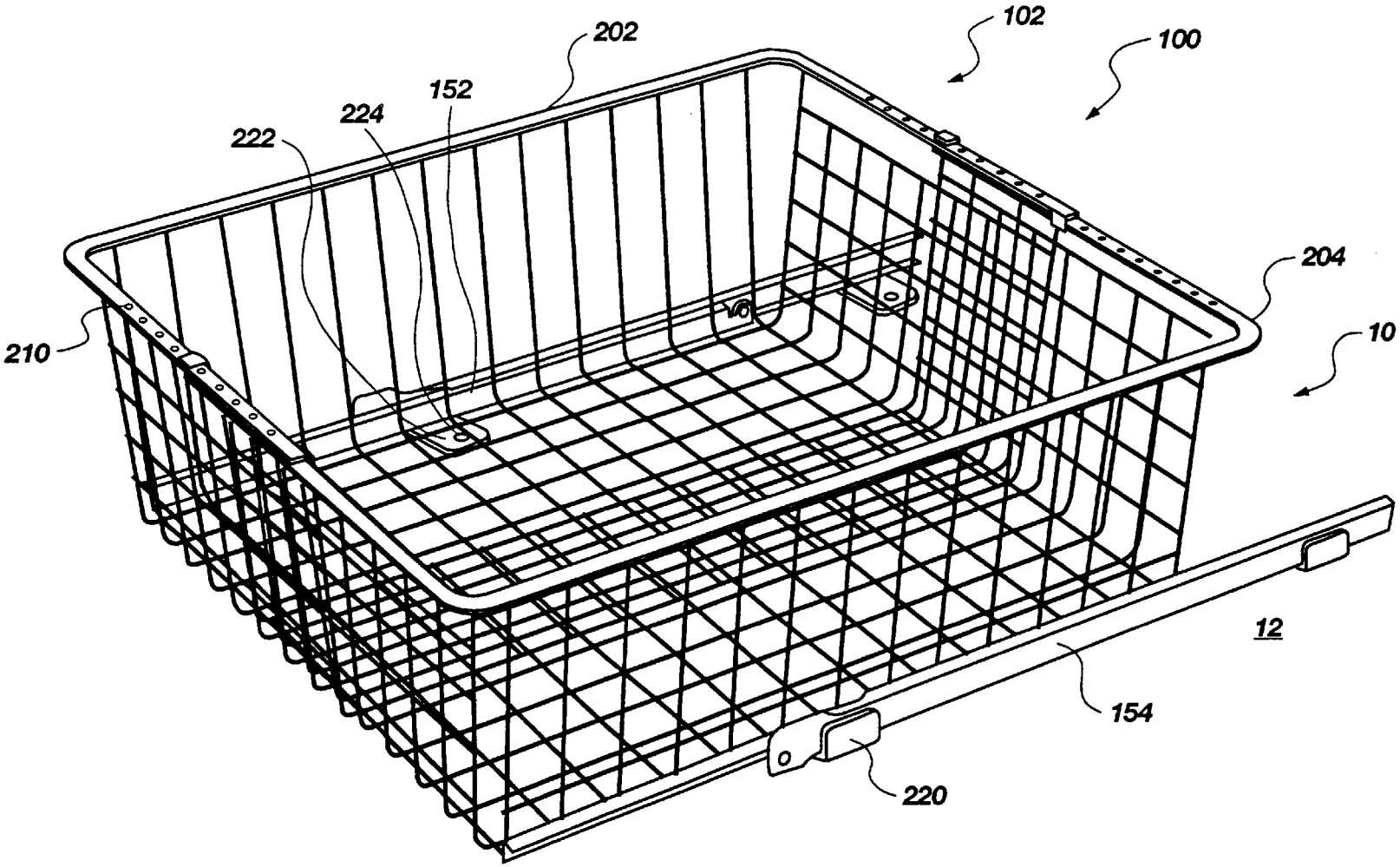
FIG. 7 is a perspective view of a second presently preferred embodiment of the present invention.
Figure 8:
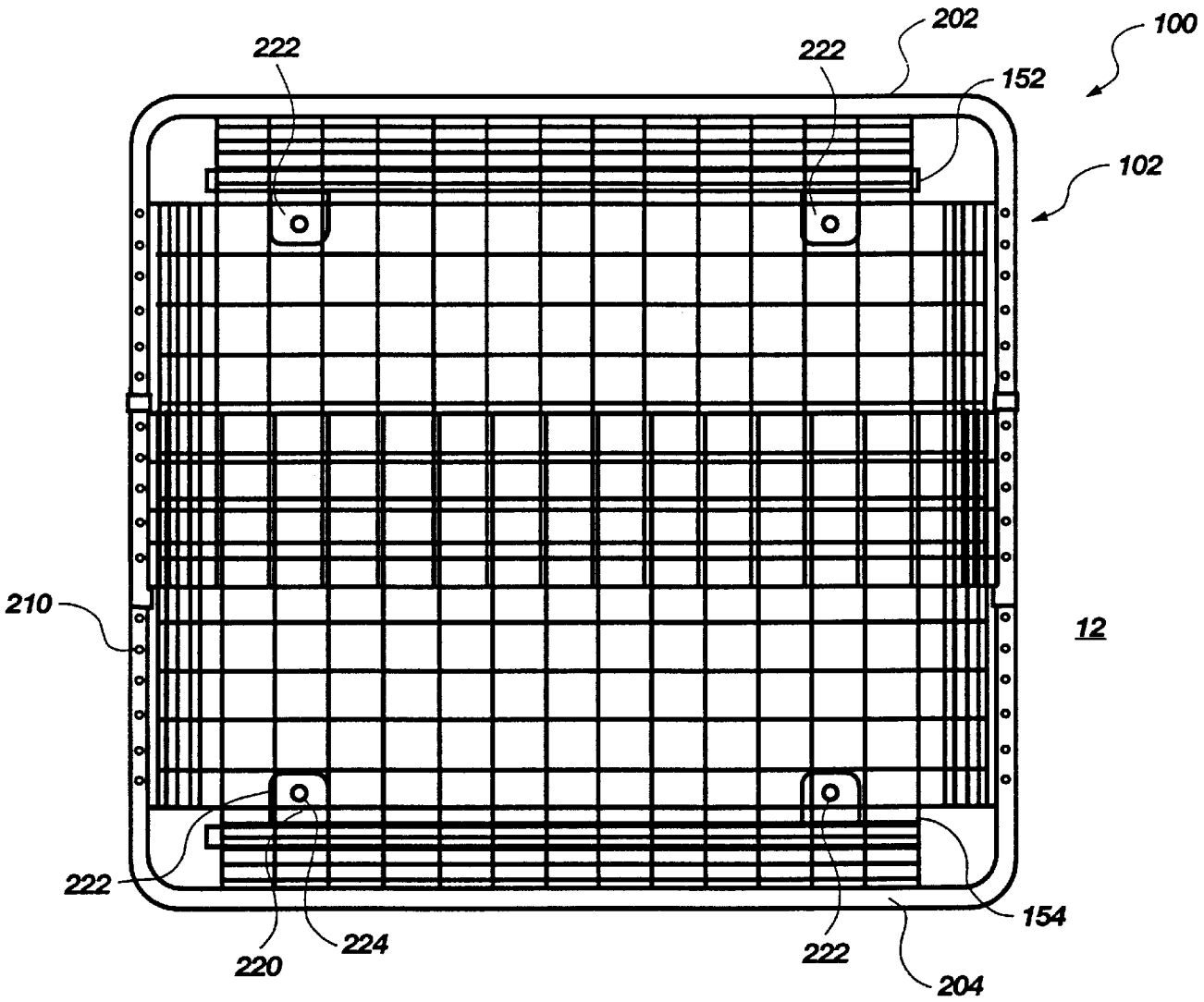
FIG. 8 is a top view of the second presently preferred embodiment of the present invention.
Figure 9:
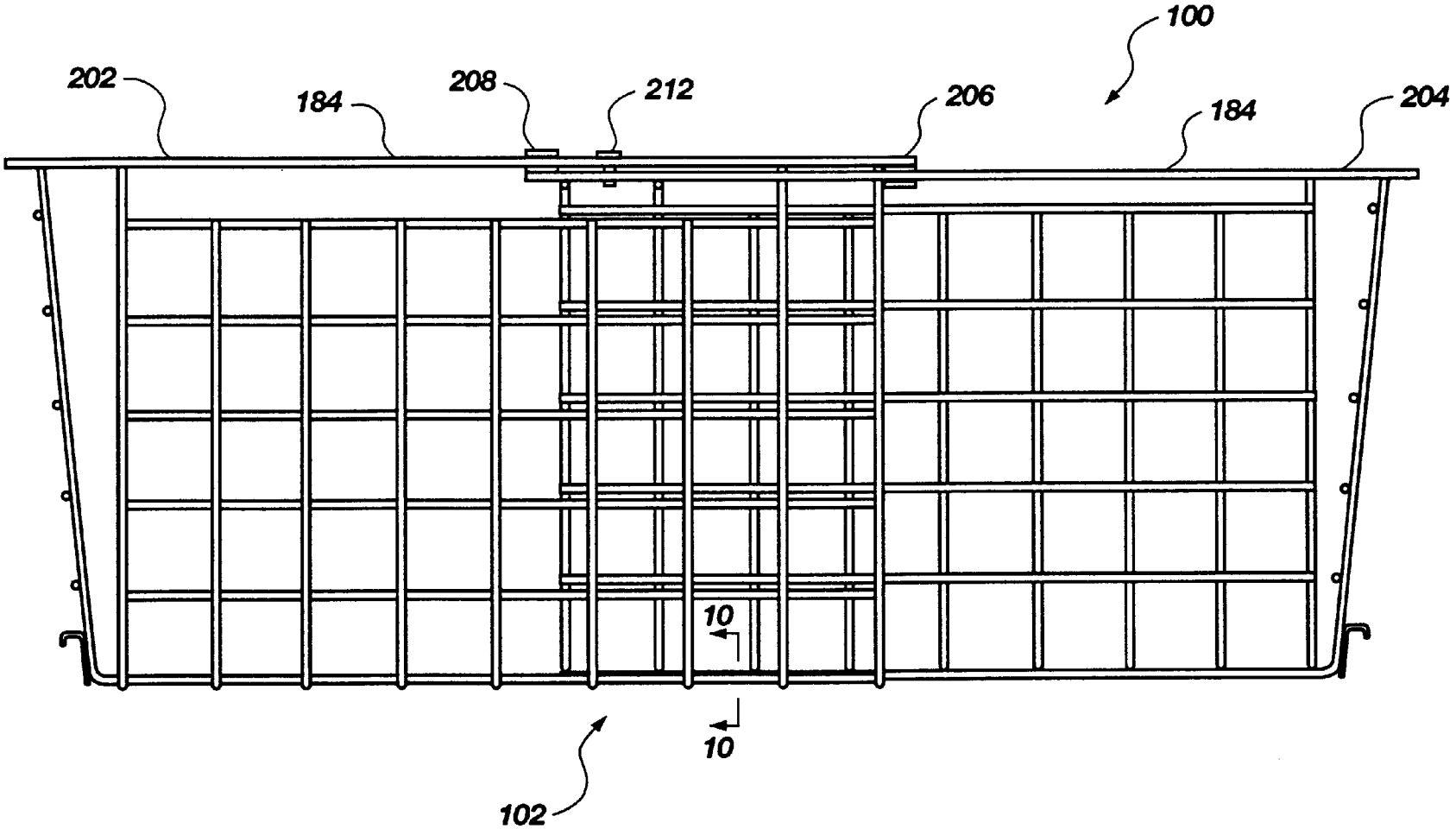
FIG. 9 is a side view of the second presently preferred embodiment of the present invention.
Figure 10:
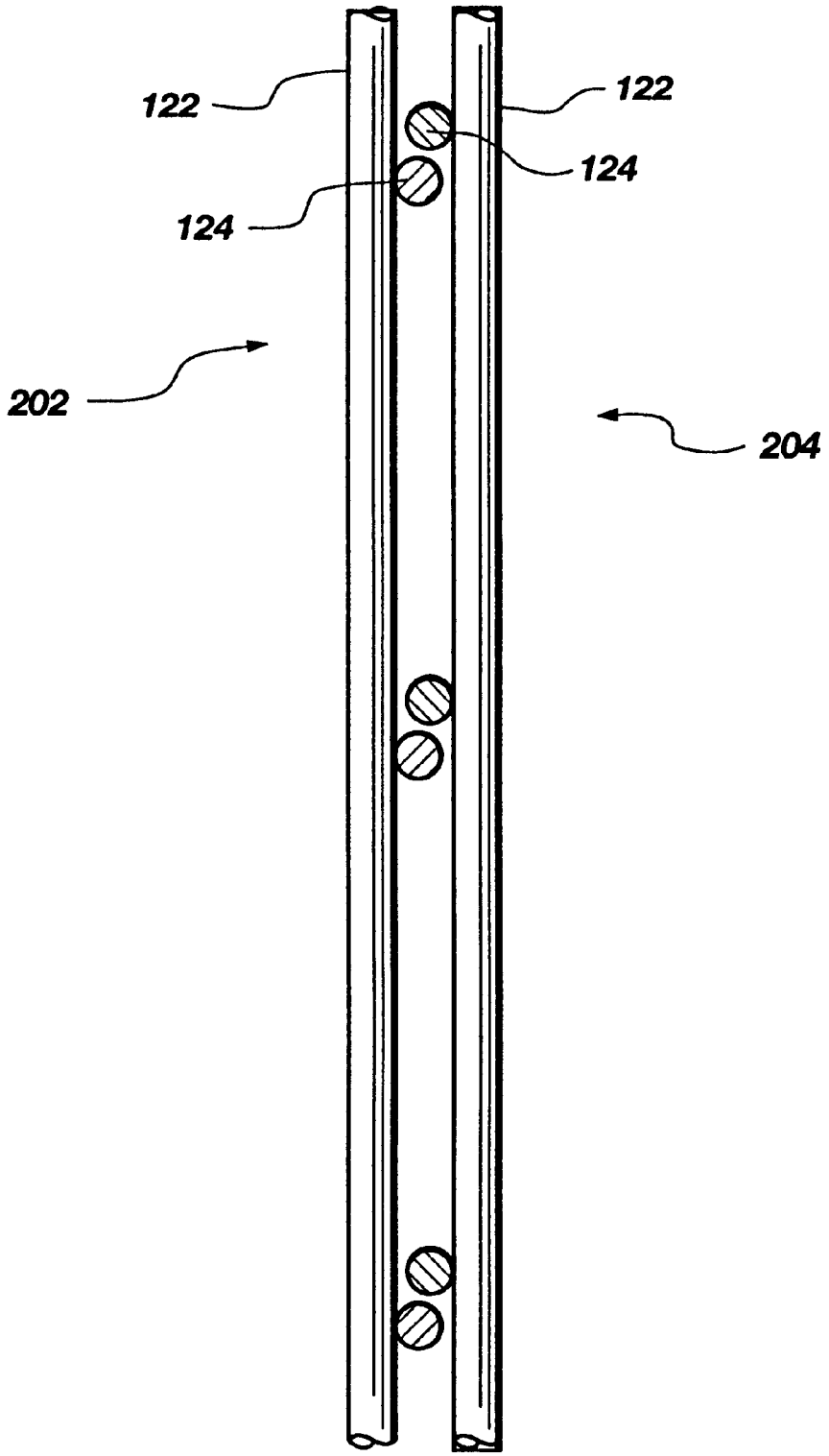
FIG. 10 is a detailed cross sectional view of the second presently preferred embodiment of the present invention taken along line 10—10 of FIG. 9.

Referring to FIGS. 7–9, a second presently preferred embodiment of the present invention will be described. In FIGS. 7–9, it can be seen that the compartment 102 preferably has a first portion 202 and a second portion 204 slidingly attached to the first portion 202. Preferably, the second portion 204 fits within the first portion 202. Preferably, the horizontal members 124 are attached, e.g. welded, to the vertical members 122 on the inside of the first portion 202 and the horizontal members 124 are attached, e.g. welded, to the vertical members 122 on the outside of the second portion 203, as shown in FIG. 10. A first tab 206 is formed on the ridge 104 of the first portion 202 and slidably engages the ridge 104 of the second portion 204, as shown in FIG. 9. Likewise, a second tab 208 is formed on the ridge 104 of the second portion 204 and slidably engages the ridge 104 of the first portion 202, as shown in FIG. 9. The tabs 206 and 208 hold the first and second portions 202 and 204 together. Furthermore, a plurality of holes 210 are formed in the ridge 104, as shown in FIGS. 7 and 8. A pin 212 may be passed through the holes 210 to fix the second portion 204 with respect to the first portion 202, as shown in FIG. 9. In this manner, the width of the compartment 102 may be adjusted by sliding the second portion 204 with respect to the first portion 202. Thus, advantageously, the compartment 102 may be adjusted to efficiently fit within the width W (see FIG. 2) of the space 10.

Because the width of the compartment is adjustable, the spacing between the tracks must be adjustable as well. Therefore, with an adjustable compartment 102, it is preferable that the base member 150 is composed of separate pieces, or that the tracks 152 and 154 not be connected by the forward and back members 156 and 158. Referring to FIGS. 7 and 8, mounting brackets 220 may be attached to the tracks 152 and 154 to secure the tracks to the horizontal surface 12. The mounting brackets 220 have feet 222 that protrude from the tracks 152 and 154 and under the compartment 102. Mounting holes 224 are formed in the feet 222 are for securing the mounting bracket 220, and the tracks 152 and 154, to the horizontal surface 12. Because the feet 222 protrude under the compartment 102 and the compartment 102 has openings 128, the feet 222 may be secured to the horizontal surface 12 through the compartment 102, such as by driving a screw into the horizontal surface 12 with a screwdriver extending through the opening 128 in the compartment 102. Therefore, the drawer 100, including the compartment 102 and tracks 152 and 154, advantageously may be correctly positioned and then immediately secured to the horizontal surface 12 without having to remove the compartment 102 or measure and mark the correct position for the tracks 152 and 154. Those skilled in the art can readily incorporate appropriate structures shown in FIGS. 1–5 into the embodiment of the present invention represented in FIGS. 7–9.

In view of the forgoing, it will be appreciated that the present invention provides an organizing and storing device for shelves and other spaces which is efficient and easy to use. The present invention also provides an organizing and storing device for shelves and other spaces which can be adjustably sized to precisely fit at least one dimension of the shelf so that space on the shelf is efficiently used but does so without requiring any cutting or permanent alterations of the device. The present invention also provides an organizing and storing device for shelves and other spaces which can be tilted so that the stored items are more easily accessible and visible. Furthermore, the present invention provides an organizing and storing device for shelves and other spaces such that the items stored in the device can be seen and provides an organizing and storing device for shelves and other spaces which can be easily positioned and installed on the shelves. Still further, the present invention provides an organizing and storing device for shelves and other spaces which can be removed from the shelf as needed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A device for organizing and storing various articles, said device being adapted for disposition in a space having a horizontal surface having a front edge having a substantially vertical surface, said device comprising:

a base member disposed on said horizontal surface, said base member having first and second tracks, each track having a forward end, and a forward member extending between said tracks and holding said tracks together in a parallel configuration;

first and second slide members each slidingly disposed in one of said tracks, said slide members sliding between an accessible position and a storage position;

a compartment pivotally attached to said slide members, said compartment pivoting between an upright position and a tilted position; and a lip formed on said forward member, said lip adapted for abutting said substantially vertical surface of said front edge of said horizontal surface for correctly positioning said base member and compartment with respect to said vertical surface such that said slide member slides said compartment between said accessible position and said storage position along a substantially perpendicular path with respect to said front edge of said horizontal surface.

2. The device of claim 1, wherein said compartment is formed of ventilated wire such that the various articles within said compartment can be seen from outside said compartment through openings provided by said ventilated wire.

3. A device for organizing and storing various articles, said device being adapted for disposition in a space having a horizontal surface, said device comprising:

a compartment means for holding said various articles;

a sliding means for sliding said compartment means between an accessible position and a storage position, said sliding means being coupled to said compartment means and adapted to be coupled to said surface;

a tilting means for tilting said compartment means between an upright position and a tilted position, said tilting means being coupled to said compartment means and said sliding means; and a tilt limiting means for limiting the tilt of said compartment means such that said compartment means is prevented from tilting past a point where said various articles in said compartment means inadvertently exit said compartment means, said tilt limiting means comprising a ridge formed along and fixedly attached to at least a portion of said compartment means; said ridge abutting said sliding means, said sliding means extending to said ridge when said compartment is in said tilted position.

4. The device of claim 3, wherein said compartment means has openings formed therein such that said various articles within said compartment means can be seen from outside said compartment means through said openings, and wherein said openings in said compartment means are formed by a plurality of horizontal members attached to a plurality of vertical members in an orthogonal arrangement, said horizontal members being attached to said vertical members at intersections;

further comprising:

a handle means attached to said compartment means for allowing a user to move said compartment means between said accessible position and said storage position; and an attachment means for attaching said handle means to said compartment means at an intersection of a horizontal member and a vertical member, said attachment means having a horizontal slot configured for receiving a horizontal member, a vertical slot configured for receiving a vertical member, and a securing means for maintaining said horizontal member in said horizontal slot and said vertical member in said vertical slot such that said handle means is attached to said compartment means.

5. The device of claim 3, wherein said openings in said compartment means are formed by a plurality of horizontal members attached to a plurality of vertical members at intersections and wherein said compartment means has a width; and further comprising:

an elongated divider having a first end and a second end attached to said compartment means, said divider having a slot formed in the first end and a slot formed in the second end, said slots each being configured to receive one of said vertical members, the divider having a length greater than said width of said compartment means but the distance between said slots being the same or less than said width of said compartment means for attaching said divider to said compartment means.

6. The device of claim 3, wherein said compartment means being removable from said surface such that said compartment means may be slid to said accessible position, tilted to said tilted position, and removed without interfering with another surface disposed above said surface.

7. The device of claim 3, wherein said compartment means is formed of ventilated wire such that the various articles within said compartment means can be seen from outside said compartment means through openings provided by said ventilated wire.

8. A device for organizing and storing various articles, said device being adapted for disposition in a space having a horizontal surface, said device comprising:

a base member adapted to be disposed on said surface, said base member having a track;

a slide member slidingly disposed in said track, said slide member sliding between an accessible position and a storage position;

a compartment pivotally attached to said slide member, said compartment pivoting between an upright position and a tilted position; and a tilt limiting means for limiting the tilt of said compartment such that said compartment is prevented from tilting past a point where said various articles in said compartment inadvertently exit said compartment, said tilt limiting means comprising a ridge formed along and fixedly attached to at least a portion of said compartment said ridge abutting said slide member, said slide member extending to said ridge when said compartment is in said tilted position.

9. The device of claim 8, wherein said compartment has openings formed therein such that said various articles within said compartment can be seen from outside said compartment through said openings, and wherein said openings in said compartment are formed by a plurality of horizontal members attached to a plurality of vertical members in an orthogonal arrangement, said horizontal members being attached to said vertical members at intersections;

further comprising:

a handle means attached to said compartment for allowing a user to move said compartment between said accessible position and said storage position; and an attachment means for attaching said handle means to said compartment at an intersection of a horizontal member and a vertical member, said attachment means having a horizontal slot configured for receiving said horizontal member, a vertical slot configured for receiving said vertical member, and a securing means for maintaining said horizontal member in said horizontal slot and said vertical member in said vertical slot such that said handle means is attached to said compartment.

10. The device of claim 8, wherein said openings in said compartment are formed by a plurality of horizontal members attached to a plurality of vertical members at intersections and wherein said compartment has a width; and further comprising:

an elongated divider having a first end and a second end attached to said compartment, said divider having a slot formed in said first end and a slot formed in said second end, said slots being configured to receive one of said vertical members, said divider having a length greater than said width of said compartment but the distance between said slots being the same or less than said width of said compartment for attaching said divider to said compartment.

11. The device of claim 8, wherein said compartment being removable from said base member such that said compartment may be slid to said accessible position, tilted to said tilted position, and removed without interfering with another surface disposed above said surface.

12. The device of claim 8, wherein said compartment is formed of ventilated wire such that said various articles within said compartment can be seen from outside said compartment through openings provided by said ventilated wire.

* * * * *